United States Patent [19]

Pulliam et al.

[11] 4,184,474

[45] Jan. 22, 1980

[54] FIREPLACE DRAFT CONTROL DAMPER

[76] Inventors: James B. Pulliam, Rte. 1, Box 193 C; Fred L. Pulliam, 311 S. Church St., both of Stevensville, Mont. 59870; Kenneth M. Kelly, 1817 W. Sussex Ave., Missoula, Mont. 59801

[21] Appl. No.: 886,047

[22] Filed: Mar. 13, 1978

[51] Int. Cl.[2] ..... F24B 7/00; F23L 3/00

[52] U.S. Cl. ..... 126/121; 126/143; 126/146; 126/163 R; 126/285 A; 126/288; 237/51

[58] Field of Search ..... 126/121, 146, 336, 285 A, 126/288, 163 R, 163 A, 143; 237/51

[56] References Cited

U.S. PATENT DOCUMENTS

| | | | |
|---|---|---|---|
| 1,670,212 | 5/1928 | Richter | 126/121 |
| 1,722,560 | 7/1929 | Cornelius | 126/121 |
| 1,987,252 | 1/1935 | Cage | 126/121 |
| 2,671,440 | 3/1954 | Dupler | 126/121 |
| 2,819,711 | 1/1958 | Robinson | 126/163 R |
| 3,169,516 | 2/1965 | Agnese | 126/121 |
| 3,180,332 | 4/1965 | Grushkin | 126/121 |
| 3,834,619 | 9/1974 | Glover | 126/121 |

*Primary Examiner*—James C. Yeung
*Assistant Examiner*—Daniel J. O'Connor
*Attorney, Agent, or Firm*—Wells, St. John & Roberts

[57] ABSTRACT

A draft control is described for selectively admitting exterior fresh air to assist combustion within the interior of a fireplace. The draft control is comprised of two interconnected and relatively slidable plates. The plates are dimensioned relative to a standard firebrick to facilitate installation in existing fireplace structures. Cool, exterior air is allowed to pass through selectively aligned apertures extending through both plates into the firebox. The plates may slide between this operative position wherein the apertures are in open contact and a closed position wherein the apertures of one plate are out of alignment and do not permit free passage of air into the fireplace interior.

3 Claims, 5 Drawing Figures

FIREPLACE DRAFT CONTROL DAMPER

BACKGROUND OF THE INVENTION

Open-hearth fireplaces are extremely popular throughout the country. However, they are extremely inefficient as room heaters. This is primarily because the fire contained within the fireplace requires and draws air from within the adjacent room. As a result the warm air within the room is pulled into the fireplace and exhausted through the chimney. A negative pressure may be produced within the room to draw cold exterior air through any open or poorly insulated areas.

In answer to this problem, fireplaces have been designed with draft provisions leading to the exterior of the room or building. With these devices, the cool exterior air may be drawn into the fireplace to support combustion rather than allowing the fire to draw the air from within the room. The result is that heat from the fireplace is radiated into the air which is retained within the room and the heated air therefore will permeate the room atmosphere and spread to other rooms. In new construction, the outside draft has been provided as a built-in element of standard fireplace shells. A problem remains, however, in how to effectively remodel existing fireplaces to include the advantage of an exterior air draft control.

BRIEF DESCRIPTION OF THE DRAWINGS

A preferred form of the present invention is illustrated in the accompanying drawings, in which.

DETAILED DESCRIPTION OF A PREFERRED EMBODIMENT

Figure 1:
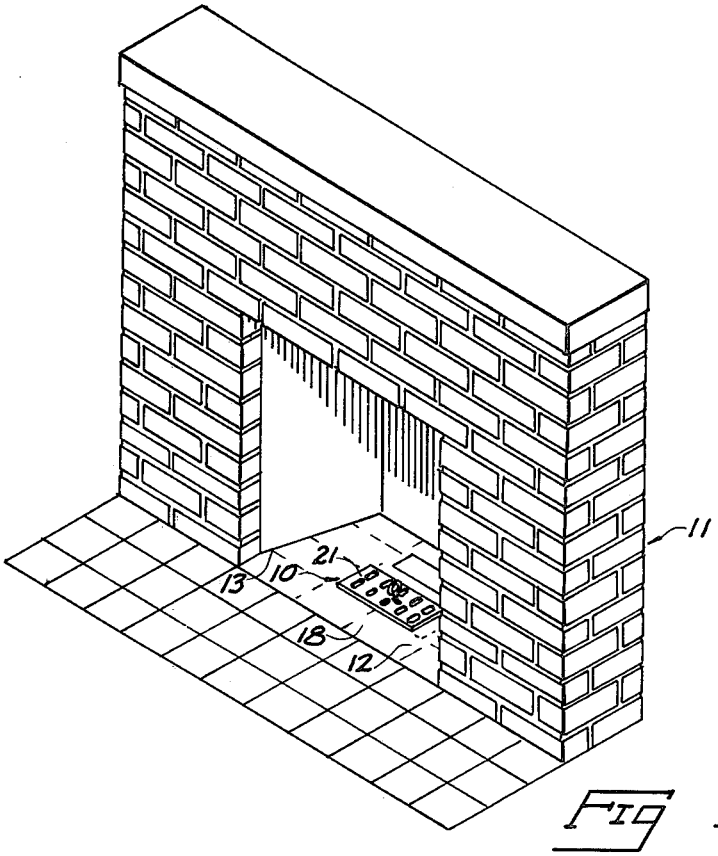
FIG. 1 is a pictorial view of a fireplace showing the present invention mounted therein.

FIG. 1 shows the present draft control as designated by the reference character 10 mounted within a conventional open-hearth fireplace 11. The draft control 10 is designed to be mounted in the hearth 12 of fireplace 11 at a position inward of a fireplace opening 13 and slightly outward of an ash drop 14. It is preferred that the fireplace include an ash drop 14 to facilitate installation of the present draft control without requiring excessive modification of the area around the fireplace.

The ash drop 14 typically openly communicates with an ash pit 15 or open space directly below the hearth. Ordinarily, a foundation slab 17 is provided below the hearth and the hearth surface is lined with standard size firebrick 18. The firebrick utilized for fireplaces is typically of a standard size, being 9 inches in length, 4½ inches in width, and 2½ inches in thickness. To facilitate replacement, the bricks 18 are usually secured within the hearth by a mortar compound that may be relatively easily removed to allow replacement of worn or broken bricks.

The present draft control 10 is designed to replace an existing firebrick 18 within a fireplace hearth. The area beneath the control 10 where the brick has been removed may be drilled through or otherwise prepared to allow open communication between the control 10 and exterior or outside air.

Figure 3:
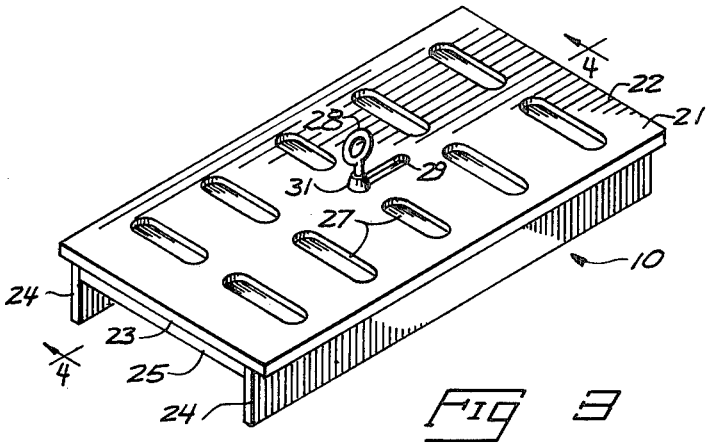
FIG. 3 is a pictorial view of the present invention.
Figure 4:
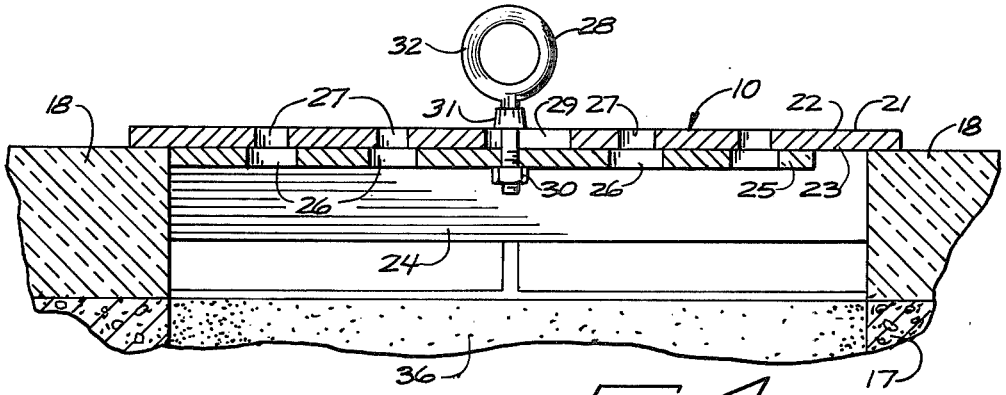
FIG. 4 is an enlarged sectional view taken along line 4—4 in FIG. 2 and showing the control in place on a fireplace hearth.
Figure 5:
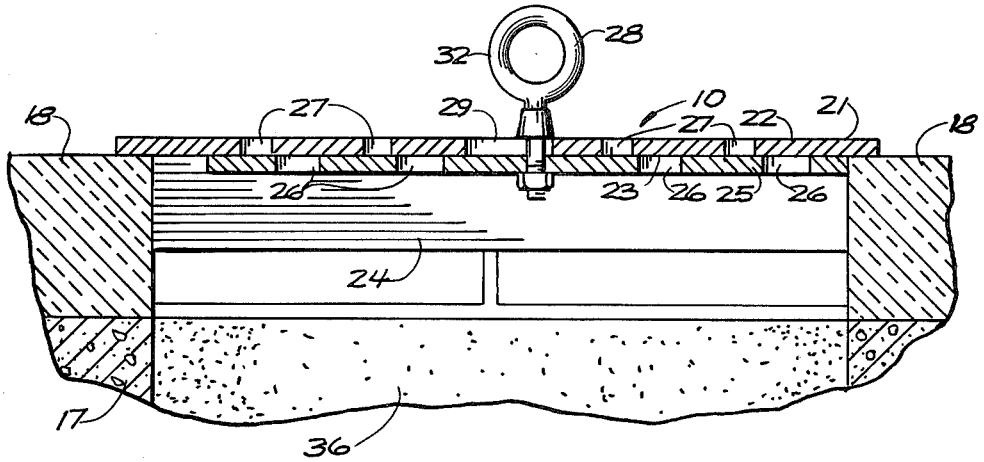
FIG. 5 is a view similar to FIG. 4 only showing a different operational relationship of the elements of my invention.

FIGS. 3 through 5 illustrate the present draft control 10 in substantial detail. As shown, the control 10 is comprised of a base plate 21 and a draft plate 25 slidably mounted thereto, both being received within an opening in the hearth formed by removing a standard size firebrick.

The base plate 21 includes a flat upper surface 22 and parallel flat lower surface 23. A pair of parallel longitudinally oriented lips 24 extend downwardly from the lower surface 23. The lips 24 are spaced apart by a distance equivalent to the standard width dimension of a firebrick, or slightly less to enable the control to be fitted within an opening created by a removed firebrick. This distance is preferably slightly less than 4½ inches. The length of lips 24 is to be slightly less than the standard firebrick length or slightly less than 9 inches.

The dimensions of the base plate 21 are to be greater than the standard width and length dimensions of a firebrick so its lower surface 23 may rest against adjacent firebrick surfaces that form the hearth 12. The lips 24 extend downwardly into the opening created by removed brick.

The draft plate 25 is slidably mounted to the base plate 21. It includes a plurality of apertures 26 of a complementary pattern on the base plate 21. The elongated apertures 26 and 27 shown in the drawing are preferably rectangular or oblong in configuration. Preferably the apertures 26 and 27 are elongated in the direction perpendicular to the direction of relative movement between the plates 21 and 25. Such an arrangement appears to be the most efficient. Preferably the length of the apertures 26 and 27 are more than twice their width.

The size, pattern and configuration of the apertures may be determined by the particular requirements of existing building structures. For example, it is desirable to provide a damper having a substantially greater open area formed by the apertures when the fireplace is located in a wall dividing a closed room with an appurtenant structure such as an attached garage that may be at least partially enclosed. Where the fireplace is formed along an exterior wall and the outside atmosphere may be opened to the control 10, relatively little open area may be desired in the apertures 26, 27 to prevent an excessive billows effect.

The draft plate 25 is slidably engaged along the lower surface 23 of base plate 21 between the lips 24. The width dimension of plate 25 must be slightly less than the distance between lips 24 and length substantially less than the length of a firebrick to enable sliding movement relative to base plate 21. Plate 25 is movable from an operative position wherein the apertures 26, 27 are fully aligned (FIG. 4) and an inoperative position wherein the apertures 26, 27 of the two plates are fully out of alignment (FIG. 5). Relative movement is accomplished through the provision of a control knob 28.

Knob 28 extends through a longitudinal slot 29 formed longitudinally in the base plate 21 to allow sliding movement of the draft plate 25 between the operative and inoperative positions. The knob 28 is mounted to the draft plate 25 by a nut 30. A collar 31 is formed integrally on the knob shaft and slidably engages the upper surface 22 of base plate 21 to support the draft plate for sliding movement along lower surface 23. The knob 28 is illustrated in the form of a ring 32 which facilitates progressive movement of the draft plate between the inoperative and operative positions through use of ordinary fireplace tools such as a poker. However, the particular configuration of the knob may vary.

Figure 2:
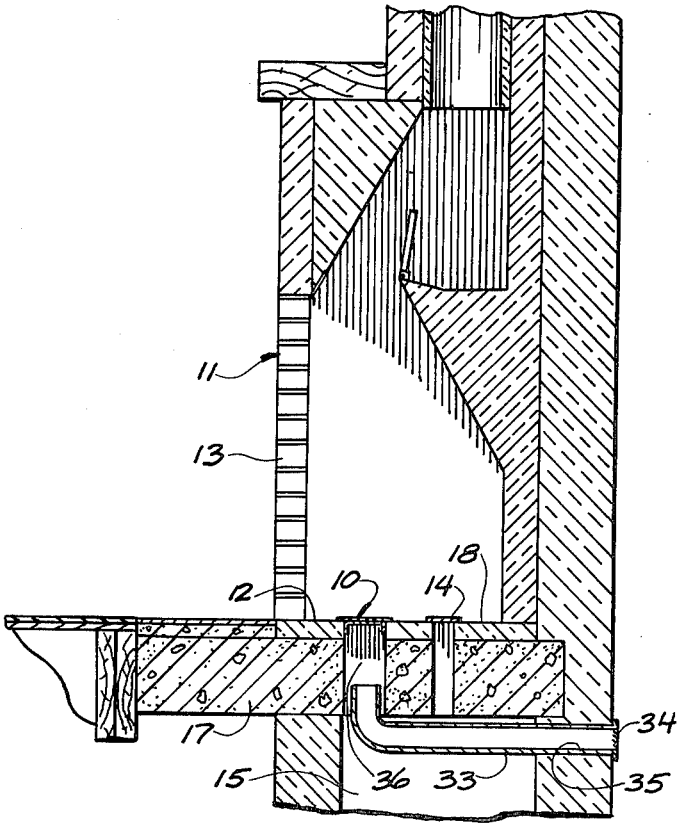
FIG. 2 is a cross section of the fireplace shown in FIG. 1.

A duct 33 and vent 34 may be provided to facilitate open communication between the draft control and exterior atmosphere. The duct 33 and vent 34 are illustrated in FIG. 2. The duct 33 may be secured through an opening 35 drilled through the exterior wall. Ducts may extend under the foundation plate 17 to another formed opening 36 having the draft control 10 at its upper end on the fireplace hearth. The vent 34 may be of a conventional form that may be continuously open or selectively operable to close the duct during the warm season and to prevent moisture problems.

To install the present draft control 10, a single firebrick 18 is first removed from the hearth, preferably at a location between the fireplace opening 13 and an ash drop 14. Once the brick is removed, the foundation material 17 below may also be removed by drilling or other appropriate methods to form the opening 36 into the ash pit 15. Of course in new construction, provision may be made during construction for air passage through this foundation area to allow open communication between the ash pit area and the fireplace interior.

Ventilation may be supplied through opening 35 formed in the exterior wall of the fireplace and by insertion of the duct 33 and vent 34 arrangement in fireplaces having ash pits 15 to prevent or minimize disturbance of the ash lying within the pit. Again, in new construction, it may be desired to form the entire ventilation passageway to the exterior of the fireplace integrally within the concrete thereby eliminating the need for the duct 33. However, it is preferred to leave the opening a size similar to that of the firebrick utilized in the hearth to facilitate the proper placement of the draft control 10.

After installation, a fire started within the fireplace may be supplied with fresh air for combustion through the draft control 10. The amount of air passed into the area of the fire is controlled by selective movement of the draft plate 25 in relation to the base plate 21. Selected amounts of combustion air may be controlled by partially closing off or moving the adjacent apertures 26 toward or away from direct alignment. In a wide open operative position as shown in FIG. 4, a maximum amount of combustion air will be passed through the duct and into the fire chamber. Of course, when the draft plate 25 is located in the inoperative position, the apertures 26, 27 are moved out of alignment and no air will pass freely into the fire chamber area through the draft control. It is contemplated that in the wide open condition, the draft control will enable passage of sufficient amounts of air to support combustion within the fire chamber of the fireplace without the fire requiring or drawing significant amounts of air from the adjacent room. That air, instead, will be heated and may circulate with air in other rooms to spread the heat from the fireplace throughout the associated building.

The above description is given by way of example to set forth the preferred form of the present invention. The description is not intended to restrict the scope of my invention. Such restriction is to be taken only from the following claims.

What I claim is:

1. A fireplace draft control damper for mounting in a rectangular opening in a fireplace in which the opening is defined by sidewalls that are spaced equivalent to the length and width dimension of a standard fireplace brick, comprising:

a base plate for covering the opening in which the base plate has front and back surfaces with length and width dimensions greater than the opening;

longitudinal lips affixed in parallel spaced orientation to the back surface of the base plate and projecting outward therefrom in which the length of the lips is less than the length dimension of a standard fireplace brick and the spaced distance between the longitudinal lips is slightly less than the width of a standard fireplace brick to enable the base plate to be fitted over the fireplace opening with the longitudinal lips projecting into the opening with the lower surface of the base plate flush with the fireplace;

a rectangular draft plate slidably mounted in the back surface of the base plate between the longitudinal lips for longitudinal movement with respect to the base plate;

a plurality of apertures extending through the base plate;

a plurality of apertures extending through the draft plate and arranged in a pattern similar to the arrangement of apertures in the base plate so when the draft plate is moved longitudinally relative to the base plate between an inoperative and operative position, the apertures in the base plate will move relative to the apertures in the draft plate from a closed condition out of alignment with the apertures in the base plate to a condition wherein the apertures are in direct alignment to allow free passage of air therethrough; and a control knob on the draft plate to facilitate sliding movement of the draft plate relative to the base plate between the inoperative and operative positions.

2. The fireplace draft control as set out by claim 1 wherein the apertures in both the base plate and draft plate are elongated and extend in a transverse direction to the direction of movement of the draft plate.

3. The fireplace draft control as set out by claim 2 wherein the apertures have lengths that are more than twice their widths.

* * * * *